US006841757B2

(12) United States Patent
Marega et al.

(10) Patent No.: US 6,841,757 B2
(45) Date of Patent: Jan. 11, 2005

(54) HEATING INSERT FOR USE WITH FOOTWEAR

(75) Inventors: Antonello Marega, Volpago del Montello (IT); Giorgio Grandin, Trevignano (IT); Robin Dempsey Caird, Glasgow (GB); Timothy Edgar Nicholl, Edinburgh (GB)

(73) Assignee: Tecnica SpA, Giavera del Montello (IT)

( * ) Notice: Subject to any disclaimer, the term of this patent is extended or adjusted under 35 U.S.C. 154(b) by 25 days.

(21) Appl. No.: 10/311,468

(22) PCT Filed: Jun. 15, 2001

(86) PCT No.: PCT/EP01/06878

§ 371 (c)(1),
(2), (4) Date: Mar. 11, 2003

(87) PCT Pub. No.: WO01/97568

PCT Pub. Date: Dec. 20, 2001

(65) Prior Publication Data

US 2003/0164361 A1 Sep. 4, 2003

(30) Foreign Application Priority Data

Jun. 16, 2000 (GB) ..... 0014622

(51) Int. Cl.[7] ..... H05B 1/00

(52) U.S. Cl. ..... 219/211; 219/528; 2/243.1; 36/55

(58) Field of Search ..... 219/211, 528, 219/529; 36/2, 6, 55; 2/243.1

(56) References Cited

U.S. PATENT DOCUMENTS

| | | | | | |
|---|---|---|---|---|---|
| 3,946,193 | A | * | 3/1976 | Giese | 219/211 |
| 4,404,460 | A | * | 9/1983 | Kerr | 219/211 |
| 4,459,461 | A | | 7/1984 | Spencer | |
| 4,665,301 | A | * | 5/1987 | Bondy | 219/211 |
| 4,665,308 | A | | 5/1987 | Courvoisier et al. | |
| 4,780,968 | A | * | 11/1988 | Bragagnolo | 36/2.6 |
| 4,781,971 | A | * | 11/1988 | Marikar et al. | 428/212 |
| 4,845,343 | A | | 7/1989 | Aune et al. | |
| 4,948,951 | A | * | 8/1990 | Balzano | 219/528 |
| 5,359,735 | A | * | 11/1994 | Stockwell | 2/243.1 |
| 5,643,480 | A | * | 7/1997 | Gustavsson et al. | 219/211 |
| 5,824,996 | A | * | 10/1998 | Kochman et al. | 219/529 |
| 6,003,248 | A | | 12/1999 | Hilgarth | |
| 6,657,164 | B1 | * | 12/2003 | Koch | 219/211 |

FOREIGN PATENT DOCUMENTS

| | | |
|---|---|---|
| GB | 587 189 A | 4/1947 |
| GB | 1 069 595 A | 5/1967 |

* cited by examiner

*Primary Examiner*—Robin O. Evans
*Assistant Examiner*—Leonid Fastovsky
(74) *Attorney, Agent, or Firm*—Birch, Stewart, Kolasch & Birch, LLP

(57) ABSTRACT

A liner for an article of footwear, particularly a ski-boot, comprises a thermally formable material which can be selectively heated by means of an insert comprising electrical resistance heating elements. The latter in turn are sandwiched between heat spreading material.

12 Claims, 4 Drawing Sheets

HEATING INSERT FOR USE WITH FOOTWEAR

This application is the national phase under 35 U.S.C. § 371 of PCT International Application No. PCT/EP01/06878 which has an International filing date of Jun. 15, 2001, which designated the United States of America.

FIELD OF THE INVENTION

This invention relates to an improved item of footwear, more particularly but not exclusively to an improved structure of ski boots, comprising a heating insert for the thermoforming and/or the heating and drying of the inner part of the footwear.

Hereinafter reference shall be made to ski boots, but it should not be construed as a limitation since the present invention is likewise useful for other items of footwear and particularly for footwear for sport or athletic use, such as for instance shoes or boots for skating, running, climbing, etc.

DESCRIPTION OF THE BACKGROUND ART

Ski boots conventionally comprise an outer rigid plastic shell, a leg portion journalled to the outer sides of the shell, and an inner liner, fully contained within the shell and adapted to comfortably receive the foot of the user. However, besides the need of comfortably housing the foot of the user, there is another need to be fulfilled, namely that of the transmission of the commands from the user's leg and foot to the ski during the sport practice, which must be as precise and quick as possible, whereby a very thick padding in the liner is not an acceptable solution.

Thus, a liner having a padding customized to the user's foot is a long felt need and a number of proposals were made in the past aiming to customize the ski boot to the user's foot by means of a formable liner, particularly a thermally formable liner.

According to a currently used technique, the liner is placed in the boot and heated by a hot air gun. Once heated, the user inserts his foot and tightens the boot, whereupon the liner is moulded to the shape of the foot and sets its shape as it cools.

This procedure requires heat to be applied until the liner reaches the appropriate temperature, and often an excessive heat is applied, leading to discomfort or worse for the user.

Moreover the liner will typically be thicker in some places, for example over the ankle bone, than in others, like e.g. over the instep. Consequently, excessive heat may be applied to the foot at the thinner parts of the liner.

It is also known to use electrically heated elements in moulding padding inserts in ski boots, as for example disclosed in U.S. Pat. No. 6,003,248.

However, the electrical heating arrangements proposed hitherto have a number of disadvantages, since they use relatively complex constructions with wires or ribbon conductors laminated to carrier films, and the distribution of the heat is not satisfactory and the resistance heating elements are relatively localised.

Another problem especially important for the ski boots is that often the inner liner becomes moistened during the use, causing discomfort for the user; moreover it would be preferable to have the inner liner dried after the use, before the ski boots are put aside for the next occasion of use. Likewise, in some cases, it would be preferable to have the inner liner slightly heated before the use.

Of course both the drying and the heating must be consistent with the places wherein the boots are used, such as for instance the ski fields, where some difficulties would exist in having proper facilities for providing electrical power of suitable characteristics.

BRIEF SUMMARY OF THE INVENTION

The main aim of the present invention is that of providing an insert for items of footwear which can be electrically heated, the heating being controlled and adjusted to permit either the thermoforming of the padding of the inner liner and the drying or warming of the liner after or before the use of the footwear.

This aim is achieved by an electrical heating insert for an article of footwear, the insert comprising electrical resistance heating means coupled with a layer of thermally conductive material, the insert being positioned, together with said thermally conductive material, adjacently to the padding to be thermoformed.

More particularly, the said electrical resistance heating means comprise at least one piece of electrically resistive polymer sheet, preferably sandwiched between two sheets of flexible thermally conductive material, said at least one piece of electrical resistance heating sheet being provided with electrical conductors for connection to a common source of electrical power.

According to a preferred embodiment of the insert of the present invention, it comprises a carrier, preferably consisting of a thermally conductive material, and a plurality of electrical resistance heating elements, the latter being provided with conductors for their connection to a common source of electrical power, said elements being adapted to attain different temperatures when connected to the said source.

According to a more preferred embodiment, the said electrical resistance heating elements are sandwiched between two sheets of said said carrier of thermally conductive material.

According to a further aspect of the present invention, an electrically heating insert is provided for use in conjunction with a thermally formable liner for customizing an article of footwear, the insert including electrical resistance heating means which, when connected to a first, relatively high electrical power level, reach a temperature sufficient to soften said thermally formable liner, whereas, when connected to a second, relatively low electrical power level attain a temperature which is not sufficient to soften said thermally formable liner but sufficient to provide drying out of moisture and/or warming of the liner.

According to a particularly preferred embodiment of the invention, the insert is embedded into said thermally formable liner, becoming an integral part thereof.

As regards the nature of the electrical resistance heating elements they must be flexible and capable of conducting electrical current, but at the same time must be endowed with a rather high electrical resistance, whereby the passage of the electrical current causes heat to be generated. A preferred material fulfilling all these requirements is a synthetic rubber loaded with carbon particles.

In turn, the thermally conductive material, which preferably forms said carrier, must be not electrically conductive and must be flexible. An example is a textile base coated with silicone rubber containing particles of high heat conductive material. Alternatively, a woven fabric coated with polyurethane can be used.

Preferably this material consists of a backing layer of glass or like fiber coated with silicone which has been doped with additives exhibiting good thermal transfer properties, for example zinc oxide and aluminium oxide. The latter material is commercially available from Warth International under the designations K177 and K228.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

Embodiments of the present invention will now be described, by way of example only, with reference to the drawings, in which:

FIG. 5 is an exploded cross-section of a modified version of the embodiment of. FIGS. 1 to 4;

DETAILED DESCRIPTION OF THE INVENTION

Figure 1:
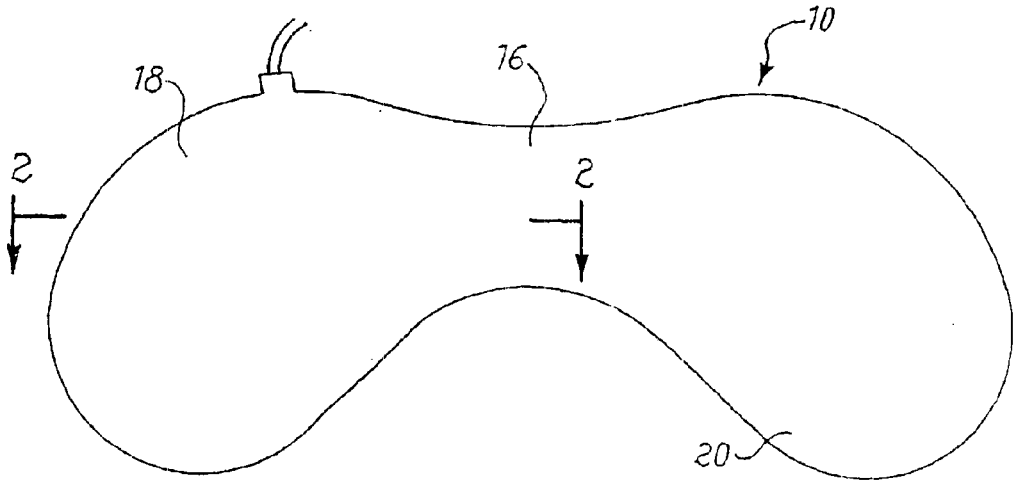
FIG. 1 is a front view of a combined liner and insert for use in a ski boot.
Figure 2:
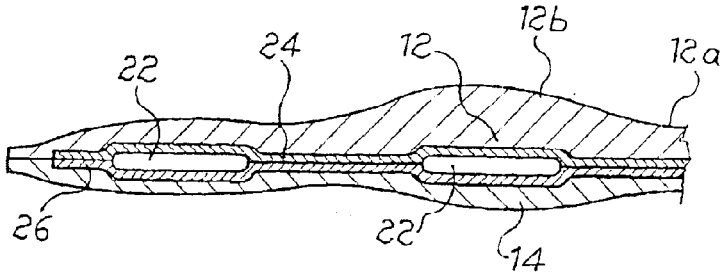
FIG. 2 is a cross-section on the line 2—2 of FIG. 1.

Referring to FIGS. 1 and 2, a combined liner and insert 10 comprises two layers 12 and 14 of a thermally formable plastic foam of a type known per se. The liner/insert 10 is of a wing shape having a narrow portion 16 which wraps around the back of the ankle in use, and a pair of wings 18 and 20 which overlie the sides of the ankle and the sides of the instep.

It is worth to notice that in the field of the ski boots the word liner normally refers to the whole shoes placed inside the outer shell and fully containing the foot from the toe to the heel. For the purposes of the present description as liner reference shall be made to the part encompassing the ankle and the rear part of the foot, as well as the instep, because this is the main part bearing the padding to be thermoformed.

As seen in FIG. 2, the foam layer is of variable thickness with a thin portion 12*a* behind the ankle and a thick portion 12*b* over the ankle bone.

Located within the layers 12 and 14 are electrical heating elements 22 which are disposed within heat conductive layers 24 and 26 which provide an even spread of the heat to the thermally formable layers 12, 14. The heat conductive layers 24, 26 are of a flexible material of high heat conductivity. As already mentioned, a number of specialist heat transfer materials may be used for these layers.

Figure 3:
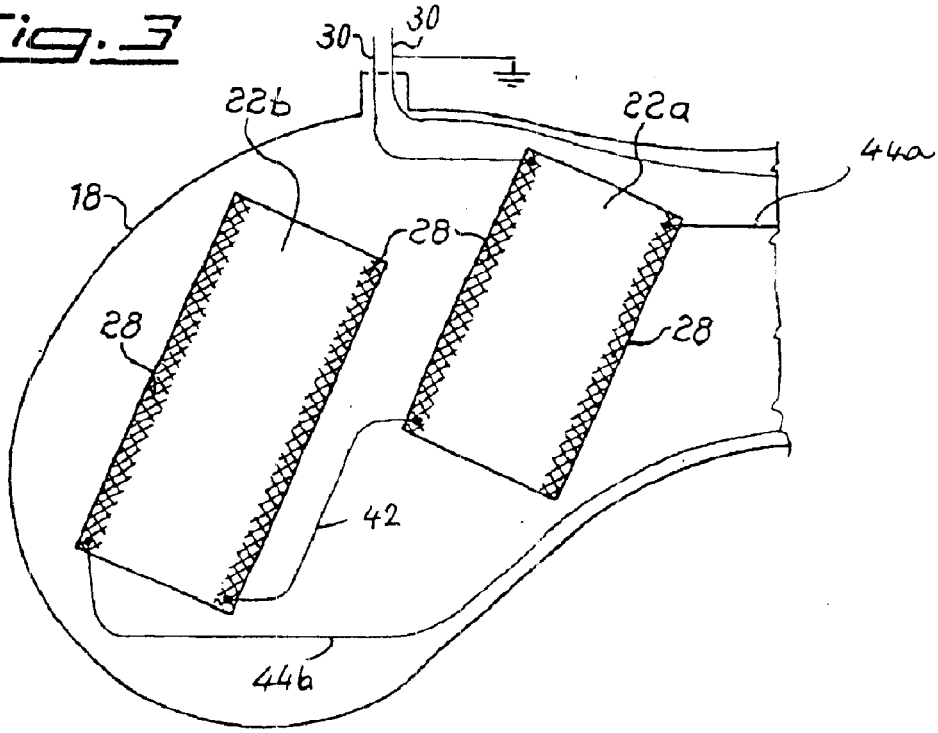
FIG. 3 is a view of part of FIG. 1 with layers removed.

Referring to FIG. 3, each of the wings 18 and 20 has a pair of heating elements 22*a* and 22*b*. These are formed from the already mentioned resistance heating materials. In the embodiment shown, the heating elements 22*a*, 22*b* have metal braid indicated at 28 stitched along their sides, connected by wires 30 to an external connector (not shown) through which electrical power can be applied when desired. The conductors connecting the various heating elements 22*a*, 22*b* of the insert are identified by reference numerals 42, 44*a*, 44*b* in FIGS. 3 and 4.

The inner heating elements 22*a* are selected such that, when a given electrical power is applied to the liner, they will reach a predefined temperature sufficient to thermoform the adjacent foam layers 12 and 14 (typically about 120° C.). The outer elements 22*b* will reach a lower predetermined temperature (typically about 80° C.) at the same applied power level, in order to thermoform the adjacent foam layers which are of a lesser thickness than the layers 12 and 14. The predefined temperatures of the different heating elements are achieved by selection of the following factors:

the formulation of the heating element material;

the dimensions of the heating elements;

the physical dimensions of the conductive paths and their placement on the heating elements;

the electrical power applied to the elements; and the duration of the applied power.

Figure 4:
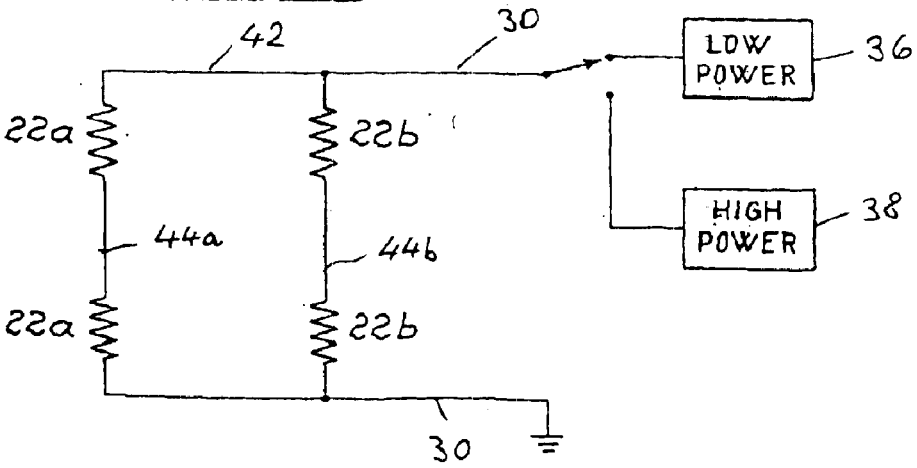
FIG. 4 illustrates the electrical connections used in conjunction with the liner/insert.

As shown in FIG. 4, the heating elements 22*a*, 22*b* are electrically connected in series parallel and can be selectively connected to a lower power supply 36 or to a high power supply 38.

To customize a ski boot to the user's foot, the insert/liner 10 is inserted into the boot. Heating elements 22 are connected to the higher power supply 38 and power is applied. At completion of a predetermined time, the heating elements 22 will have generated sufficient heat for thermoforming to occur. The power is disconnected from the heating elements 22, preferably automatically by a timer circuit in the power supply.

The wearer's foot is then inserted into the boot and liner. The boot is tightened and the foam layers 12 and 14 undergo a deformation to the shape of the foot and to the shape of the boot. As the foam cools, it returns to its non-deformable state and retains the customised shape of the foot and of the boot.

The thermally conductive layers 24 and 26 ensure that the softening of the foam is more rapid and more uniform than would occur with heating elements alone.

Because the heating elements 22 are in the middle of thermally formable foam layers, the liner can be moulded both to the foot and to the shell of the boot. This feature allows one style and type of liner to be used across a range of boot sizes, differing designs, and also for use in boots of other manufacturers. This is in contrast with the prior art, where a separate type of liner is required for each boot size, each style and each manufacturer.

The heating elements are permanently embedded in the liner. This allows a second mode of use, where the presence of the heating elements allows the liner to be dried after use, either in or outside the boot. In this case, the heating elements are connected to the lower power supply 36 which produces element temperatures of approximately 60 and 50° C. The power supplies 36, 38 could supply the desired power by supplying two different voltages, for example 12V and 24V. However, this may not provide accurately reproducible temperature effects because of non-uniformity of voltage drop owing to variations in conductors and connectors. It is therefore possible that the power supplies are constant current devices, thus giving accurate $I^2R$ heating in the heating elements.

Figure 5:
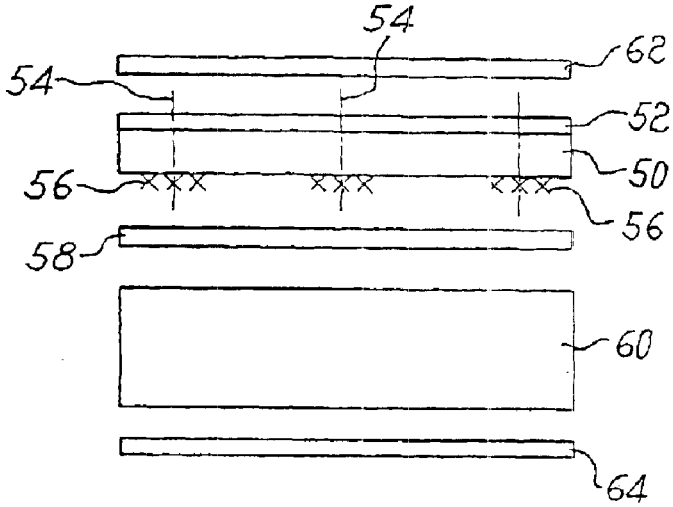

FIG. 5 shows an exploded cross-section through part of a modified embodiment. A heating element 50 of thermally conductive material is secured to a heat spreading member 52 by stitching indicated at 54 which is also used to secure flattened braid conductors 56 to the material 50. A further heat spreading member 58 is secured over the conductors 56 by adhesive. A thermoformable plastics layer 60 is secured over the further heating spreading member 58 by adhesive, stitching, HF welding, or other fixing method. The assembly is completed by an outer fabric and foam layer 62 and an inner fabric layer 64 which may also be secured by adhesive. It will be appreciated that the overall shape of the liner insert is as shown in FIGS. 1 and 3.

In this embodiment, the heat spreading members 52 and 58 are flexible, textile based members made from a material of low thermal inertia. One suitable example is a base fabric weave coated on one side with polyurethane and on the other side with a waterproof coating, such as is used in foul weather clothing. One suitable material is available from Lothian Coated Fabrics under the designation CF0706. Such materials are considerably cheaper than the specialist thermal transfer materials such as K177.

It has also been found that in transmitting heat through the thickness of the liner and particularly in transferring heat across the area of the liner and reducing hot spots, the arrangement shown and described with reference to FIG. 5 is very effective.

Figure 6:
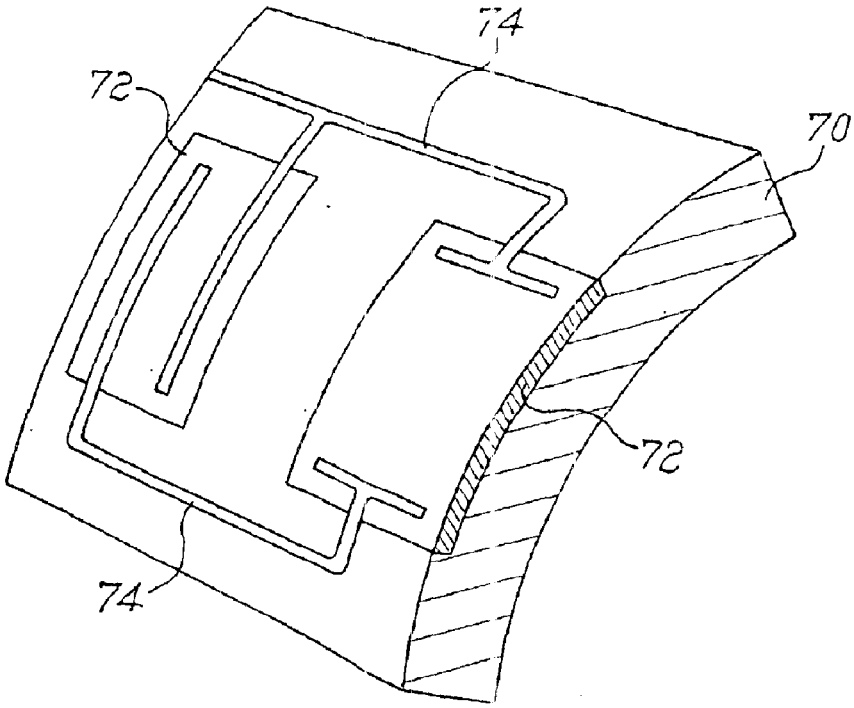
FIG. 6 is a diagrammatic partial perspective view of another embodiment.

A further embodiment is illustrated in FIG. 6. In this embodiment a generally boot shaped liner 70, only part of which is diagrammatically shown in this figure, is preformed from a thermoformable polymer material which is not electrically conductive but which is capable of spreading heat, suitably a non-electrically conducting polymer. The liner 70 is moulded around four heating elements, two of which are shown at 72. Electrical connection to the heating elements 72 is provided by conductive tracks 74 which are laid down by screen printing with a conductive polymer ink. This embodiment operates in the same way as the previous embodiments, but can be more easily mass produced.

Figure 8:
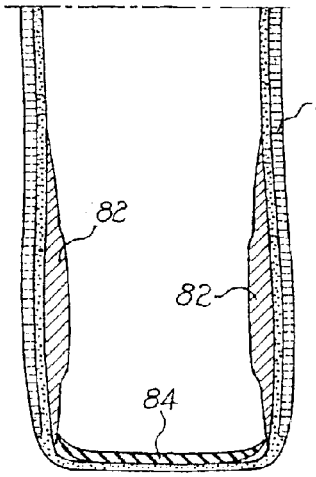
FIG. 8 is a cross-section, taken perpendicularly to the main longitudinal plane, of the liner of FIG. 7.
Figure 7:
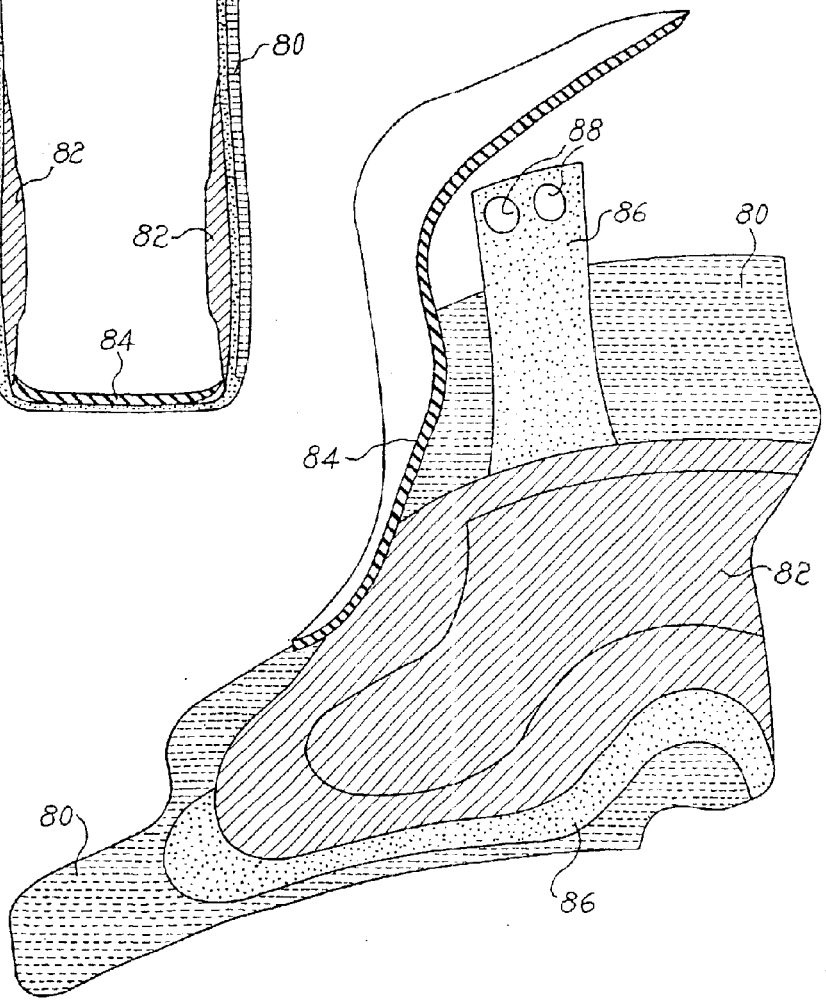
FIG. 7 is a partial side view of a liner for ski boots comprising the insert according to the invention.

In FIGS. 7 and 8, the present invention is more clearly illustrated with reference to the inner liner for a ski boot, comprising an upper 80, a padding 82 and an internal sole 84.

The reference 86 indicates the insert according to the invention, terminating at the upper end with a schematic indication of the points connectable to the outer electrical power supply (88).

From FIG. 8, it is readily appreciated how the invention operates. Of course, besides the inner padding 82, also an outer padding can be and is preferably provided (although not shown), whereby the operation of the electrical heating means causes at the same time the thermoforming of both paddings, and the liner is thus more accurately shaped according not only to the foot of the user but also to the internal profile of the outer shell of the boot.

The use of electrically resistive polymer heating elements is simple and economical, but other forms of heating element may be used, such as serpentine wires or flexible printed circuits.

The use of metallic braid to connect the resistive polymer is a relatively simple system and has advantages of flexibility. Varying widths of braid, variable spacing between braid conductors, differing methods of stitching and differing stitching tensions can be used to provide differing power carrying capacity and power transferring capability for individual system requirements. A suitable form of braid is tinned copper braid of the type used in earthing straps for equipments. The braid may be stitched to the polymer with metallic thread to improve the electrical connection.

The use of stitched-on metallic braid does, however, present problems of accuracy and repeatability in terms of electrical parameters, and is relatively labor intensive in manufacture. To avoid or reduce these drawbacks, other conductor schemes are possible.

Lastly, it is worth to mention that the padding of the liner might be already partially moulded, whereby the heating insert according to the invention can be exploited to achieve the final customising to the foot of a particular user, leading to a reduced duration of the operation and to optimum results.

As above indicated with reference to FIG. 6, one alternative is the use of conductive polymer inks, which can be applied by silk screening or other printing techniques. It is also possible to use conductive paints such as those based on silver or nickel, which can be applied by silk screening or other printing processes, or by spraying Conductive paint can also be applied to tinned copper braid to achieve better contact.

Another option is the use of embedded conductors, either by sandwiching conductors between two sheets of conductive polymer, or by moulding the polymer around conductors as a unitary moulding. The embedded conductors can be wires, flat strips, or flexible circuits.

Other options include:

(a) Conductors, which may be flexible copper circuits or nickel flat strips, secured to the surface of the polymer by electrically conductive adhesive;

(b) polymer doping, in which the base polymer is doped in some parts to provide a resistance heating element, while other parts are doped to produce low resistance and act as a conductor;

(c) electroless plating of conductor tracks.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electrical heating insert for thermoforming or drying the thermally formable padding of an article of footwear, comprising;

electrical resistance heater;

a layer of thermally conductive material, adjacent to the padding to be thermoformed or dried by said electrical resistance heater;

electrical conductors for connection to a common source of electrical power, said electrical heater comprises at least one piece of electrically resistive polymer sheet, adapted to reach a temperature sufficient to soften said thermally formable padding, when connected to a first relatively high power level of said common source of electrical power by said electrical conductors, and to attain a temperature which is not sufficient to soften said thermally formable padding but sufficient to provide drying out of moisture and/or warming of the padding, when connected via the electrical conductors to a second, relatively low electrical power level of said common source of electrical power.

2. The electrical heating insert according to claim 1, wherein said at least one piece of electrically resistive polymer sheet is sandwiched between two layers of flexible thermally conductive and non-electrically conductive material.

3. The electrical heating insert according to claim 1, further comprising:

a carrier, having a thermally conductive material; and a plurality of electrical resistance heating elements being provided with conductors for their connection to a common source of electrical power and adapted to attain different temperatures when connected to the source.

4. The electrical heating insert according to claim 3, wherein said carrier of thermally conductive material is a sheet.

5. The electrical heating insert according to claim 1 or 4, wherein said thermally conductive material is a textile base coated with silicone rubber containing particles of high heat conductive material.

6. The electrical heating insert according to claim 1 or 4, wherein said thermally conductive material is woven fabric coated with polyurethane.

7. The electrical heating insert according to claim 1, wherein the insert includes thermally formable padding and is used as the liner of a ski boot.

8. The electrical heating insert according to claim 7, wherein said high electrical power source supplies 24 Volts and said low electrical power source supplies 12 Volts.

9. The electrical heating insert according to claim 1, wherein the heater includes at least two heater elements which heat at different temperatures.

10. The electrical heating insert according to claim 9, wherein the two heater elements are spaced from one another and wherein a thickness of the thermally formable padding varies adjacent the two heater elements.

11. The electrical heating insert according to claim 9, wherein the at least two heater elements further include two additional heater elements so that two pairs of heater elements are provided, one heater element of each pair heats at a first temperature and a second one of the heat elements of each pair heats at a second temperature, the first temperature being different from the second temperature.

12. The electrical heating insert according to claim 11, wherein the first temperature is about 120° C. and the second temperature is about 80° C.

* * * * *